US007401438B2

(12) United States Patent
Wild

(10) Patent No.: US 7,401,438 B2
(45) Date of Patent: Jul. 22, 2008

(54) REVOLVING DOOR FOR PLACEMENT IN A FACADE OF A BUILDING

(75) Inventor: Paul Joseph Wild, Sandy, UT (US)

(73) Assignee: Boon Edam B.V., Edam (NL)

( * ) Notice: Subject to any disclaimer, the term of this patent is extended or adjusted under 35 U.S.C. 154(b) by 0 days.

(21) Appl. No.: 10/446,289

(22) Filed: May 22, 2003

(65) Prior Publication Data

US 2004/0006919 A1 Jan. 15, 2004

Related U.S. Application Data

(63) Continuation of application No. PCT/NL01/00855, filed on Nov. 23, 2001.

(30) Foreign Application Priority Data

Nov. 24, 2000 (NL) ..... 1016700

(51) Int. Cl.
*E05D 15/02* (2006.01)

(52) U.S. Cl. ..... 49/42; 49/506

(58) Field of Classification Search ..... 49/42, 49/41, 506; 109/2, 3, 6, 7, 8
See application file for complete search history.

(56) References Cited

U.S. PATENT DOCUMENTS 3,697,972 A * 10/1972 Brown ..... 43/59
4,060,039 A * 11/1977 Lagarrigue ..... 109/3
4,255,900 A * 3/1981 Magnani ..... 49/141
4,557,073 A * 12/1985 Sandling ..... 49/41
4,586,441 A * 5/1986 Zekich ..... 109/8
4,656,954 A 4/1987 Tonali
4,843,761 A * 7/1989 Sandling ..... 49/41
5,076,013 A * 12/1991 Gallenschutz et al. ..... 49/42
5,542,211 A * 8/1996 Colombo ..... 49/42
5,711,111 A * 1/1998 Nyffenegger et al. ..... 49/42
6,061,960 A * 5/2000 Korai ..... 49/42
6,543,185 B1 * 4/2003 Borelli ..... 49/42

FOREIGN PATENT DOCUMENTS

DE 3730031 A1 * 3/1989
GB 1223699 A 3/1971
JP 2001-32642 A * 2/2001

* cited by examiner

*Primary Examiner*—Jerry Redman
(74) *Attorney, Agent, or Firm*—Jeffrey D. Myers; Vidal A. Oaxaca; Peacock Myers, P.C.

(57) ABSTRACT

A revolving door for placement in a facade of a building to provide an entrance and exit to the building, comprising a rotation axis and door leaves mounted on the rotation axis, placed between cylinder segment-like shell elements, wherein the shell elements comprise at least one movable wall segment. The movable wall segment either blocks or gives way to an area between the entrance and the exit.

6 Claims, 6 Drawing Sheets

REVOLVING DOOR FOR PLACEMENT IN A FACADE OF A BUILDING

CROSS-REFERENCE TO RELATED APPLICATIONS

This application is a continuation of international patent application PCT/NL01/00855 filed on Nov. 23, 2001, which claimed priority to Netherlands patent application NL 1016700 filed on Nov. 24, 2000, and the specification of each of the foregoing is incorporated herein by reference.

BACKGROUND OF THE INVENTION

1. Field of the Invention (Technical Field)

The invention relates to a revolving door for placement in a facade of a building to provide an entrance and exit to the building, comprising a rotation axis and door leaves mounted on the rotation axis, placed between cylinder segment-like shell elements.

2. Description of Related Art

Such a revolving door has been manufactured and marketed by applicants for decades. For some applications the shell elements also comprise one or more than one moveable wall segments, as disclosed in, for example, GB-A-2,052,612 and NL-A-9302235.

When used for security purposes, the known revolving door is often provided with a card reader in order to only allow authorized persons to enter or leave the building via the revolving door. It is also known to further complete the revolving door with sensor means, which serve in particular to ensure that not more than one person at a time can pass through the revolving door. A further known embodiment of the revolving door is provided with a weapon detection system.

At an attempt by an unauthorized person to pass through the revolving door or in the event that the person carries a weapon, the known revolving door will react with various possible interventions. A first possibility is that the rotation of the door leaves is blocked so that passage through the revolving door is no longer possible in any way. An alternative embodiment that is known from the prior art also comprises a sliding door at the inside of the building, which is activated in such a situation so that although the door leaves are still able to rotate, they effectively prevent entry into the building. Such a sliding door may also be provided at the outside of the building so that an effective obstruction to exiting the building may be realized in this way.

A revolving door suitable for placement in a facade of a building to provide an entrance and exit to the building, comprising a rotation axis and door leaves mounted on the rotation axis, placed between cylinder segment-like shell elements, wherein the shell elements comprise at least one movable wall segment that either blocks or affords admittance to an area between the entrance and the exit, is known from GB-A-1,223,699. This known revolving door is particularly intended for application in airports when two or more moving streams of people must cross each other without intermingling.

BRIEF SUMMARY OF THE INVENTION

The object of the invention is to improve the known revolving door such that when placed to provide an entrance and exit to a building, an unauthorized person wishing to enter or to leave the building, or a person carrying undesirable objects, may be examined more closely by personnel authorized to do so.

To this end the revolving door according to the invention is characterized in that it is provided with a sensor system for the control of the moveable wall segment. In this way the respective person may be accompanied to the area between entrance and exit where further examinations may take place.

BRIEF DESCRIPTION OF THE SEVERAL VIEWS OF THE DRAWINGS

The accompanying drawings, which are incorporated into and form part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
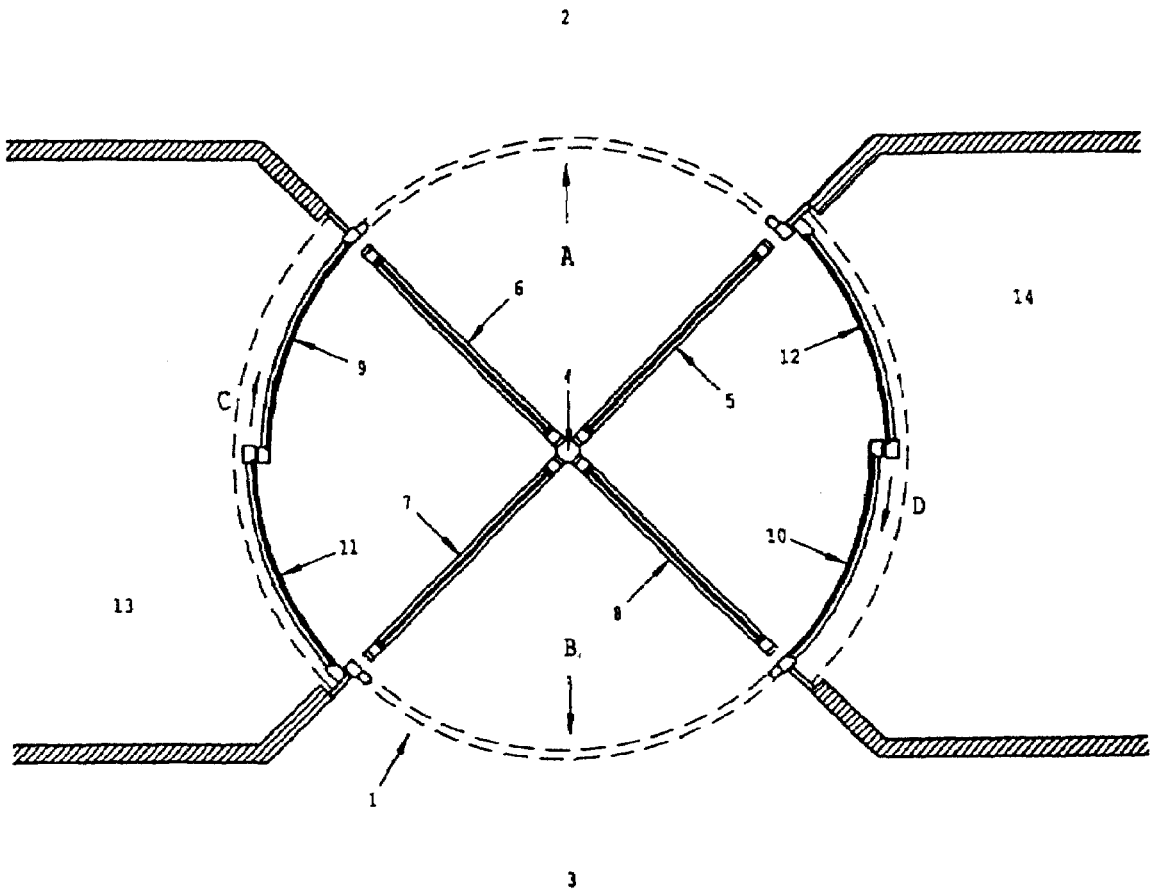
FIG. 1 is a top view of a preferred embodiment of the present invention.

In order to meet the above mentioned requirements effectively, it is desirable that rotation of the door leaves is allowed or refused, respectively depending on said sensor system. In this way the respective person is obliged, if the occasion arises, to actually enter the area where the examination can take place.

If the above mentioned examination is not necessary and the person may enter or leave the building, the entry to the area between the entrance and exit is blocked. In the other case, if the person or the objects the person is carrying have to be subjected to further investigation, the wall segment will allow admittance into the area intended for this purpose while blocking the door leaves. If necessary, this area may be embodied with extensive security measures. It is also possible that the security personnel remains absent from the area, and that the person who has walked in is detained until the police authorities have arrived.

The proper working of the revolving door according to the invention will benefit by the sensor system having a first sensor placed inside the building or in the revolving door for detecting objects or the like, that are unauthorized to move to the exit of the building.

It is also desirable for the sensor system to comprise a second sensor outside the building for detecting undesirable objects or the like, in particular weapons, moving to the entrance building. The revolving door according to the invention makes it possible to differentiate in a simple manner between unauthorized persons wishing to leave the building and unauthorized persons wishing to enter the building.

To this end it is only required that there are two oppositely positioned cylinder segment-like wall elements, that each wall element comprises a moveable wall segment defining a first or second area, respectively, that after the respective wall segment has given way, the first area can only be entered from inside the building, and that after the respective wall segment has given way, the second area can only be entered from outside the building.

The invention also relates to a method for operating a revolving door comprising a rotation axis and door leaves mounted on the rotation axis, placed between cylinder segment-like wall elements, which comprise at least one movable wall segment, and which is characterized in that in a first position of the at least one wall segment the shell elements form a closed front along which the door leaves can be moved to provide a passage between an entrance and an exit of the revolving door, and in that in a second position of the at least one wall segment the closed front of the shell elements is interrupted to afford admittance to an area between the entrance and the exit of the revolving door, while simultaneously rotation of the door leaves is interrupted in order to block the passage between the entrance and the exit of the revolving door.

The invention will now be elucidated with reference to the drawing, in which FIGS. 1 to 5 show in horizontal cross section and in top view the revolving door according to the invention.

Identical reference numbers used in the figures always refer to similar parts.

Referring first to FIG. 1, the various parts of the revolving door according to the invention are elucidated.

This revolving door 1 is placed in the facade of a building having an inside 2 and an outside 3. The revolving door 1 is provided with a rotation axis 4 mounted on which are door leaves 5 to 8. The rotation axis 4 and the door leaves 5 mounted thereon are placed between cylinder segment-like shell elements 9 and 10. In this way the revolving door 1 provides the building with an entrance A and an exit B, respectively.

The invention also relates to the embodiment of the shell elements 9, 10, such that there is at least one movable wall segment 11, 12. FIG. 1 shows two such wall segments. The first wall segment 11 is part of shell element 9, while the second wall segment 12 is part of the shell element 10. As is further clearly shown in the Figure, after being moved in the direction of arrow C, wall segment 11 affords admittance to a first area 13, and after being moved in the direction of arrow D, the second wall segment 12 affords admittance to a second area 14. The use of the revolving door 1 according to the invention is now concisely illustrated with reference to the FIGS. 2 to 5.

Figure 2:
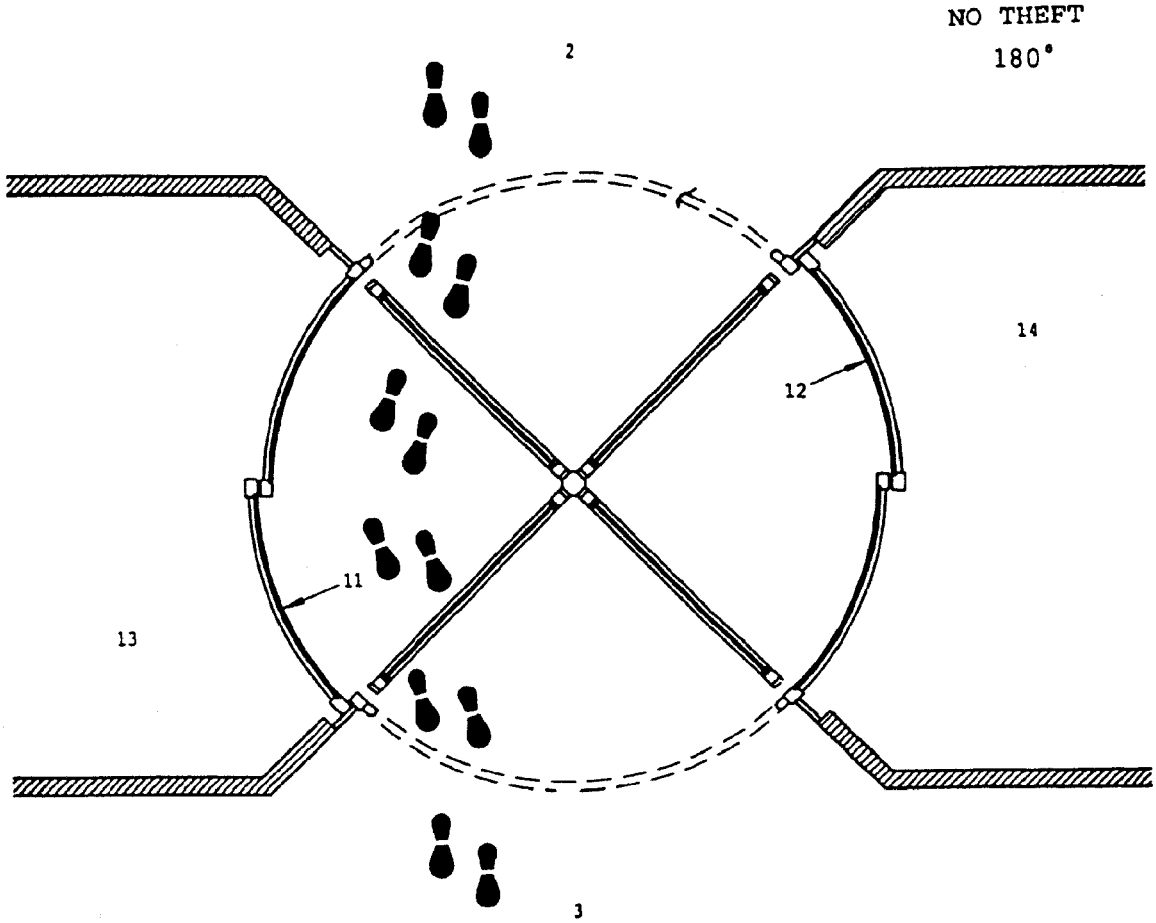
FIG. 2 is a top view of a preferred embodiment of the present invention illustrating how a user exits a building through the invention.
Figure 3:
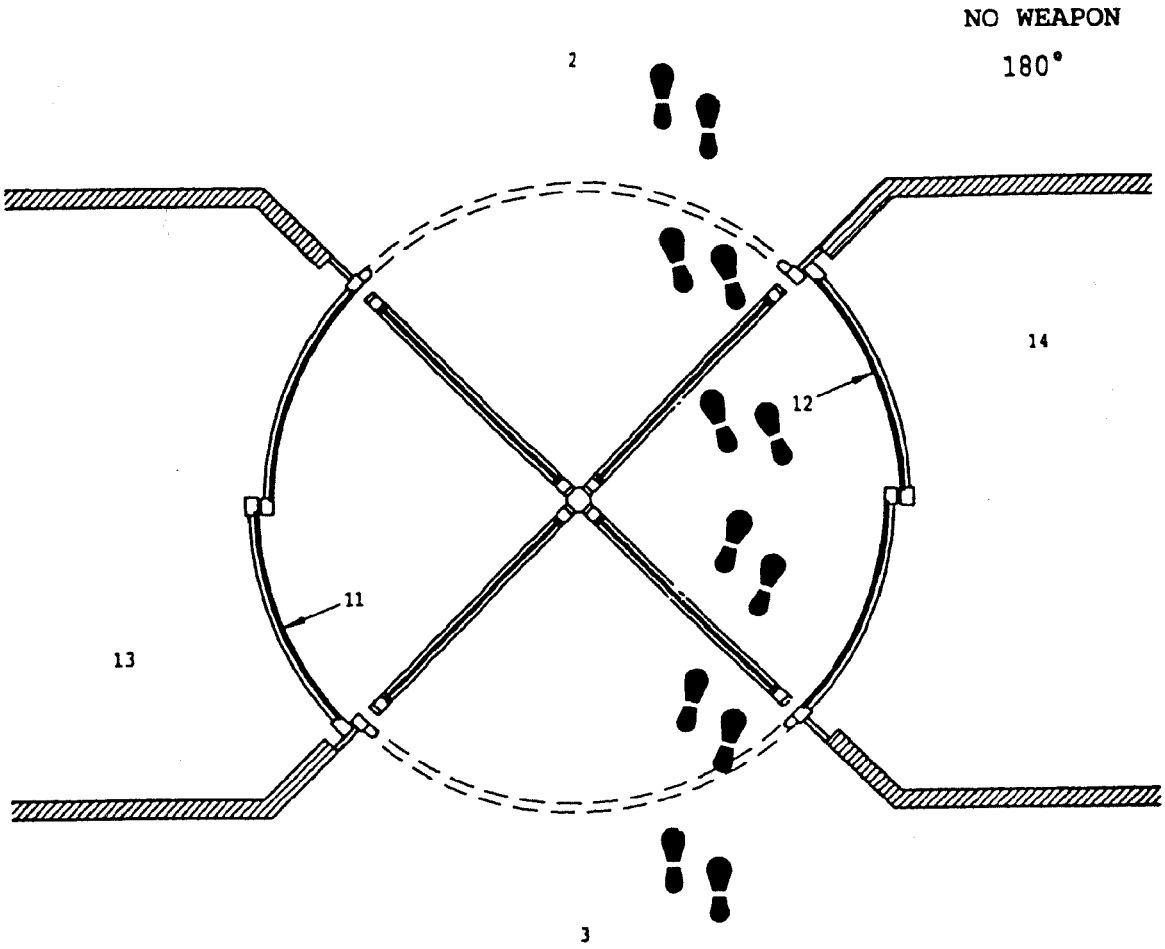
FIG. 3 is a top view of a preferred embodiment of the present invention illustrating how a user enters a building through the invention.

FIG. 2 shows that a person leaves the building from the inside 2 to the outside 3 and that the wall segments 11 and 12 block the admittance to the first area 13 and second area 14. Such a use of the revolving door according to the invention corresponds with the use possible with the revolving door according to the prior art. Similarly, FIG. 3 shows a person passing from outside 3 of the building to inside 2 of the building. In this situation also, where the person is authorized and does not carry undesirable objects, the movable wall segments 11 and 12 remain closed so that admittance to the first area 13 and second area 14 is blocked.

Figure 4:
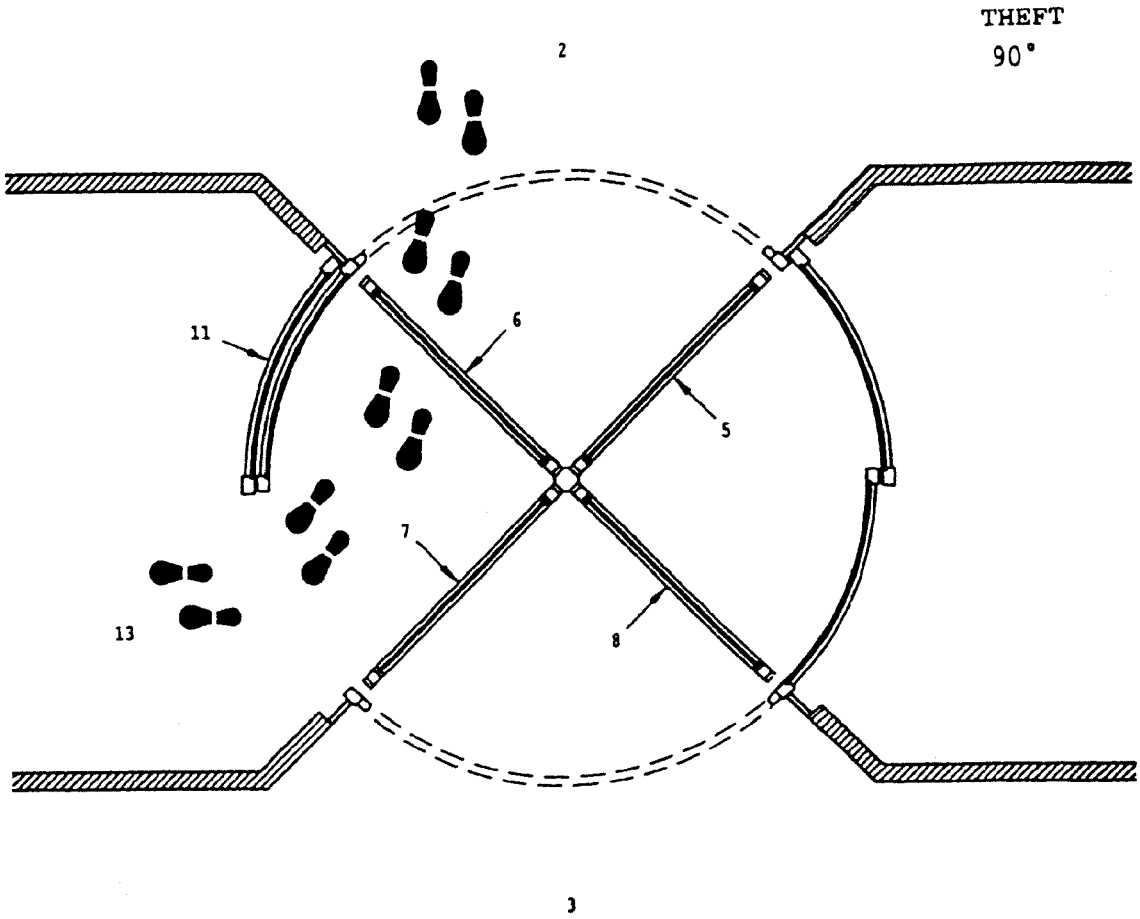
FIG. 4 is a top view of a preferred embodiment of the present invention illustrating how a security feature shunts an exiting user to a secured area of a building.

The use of the revolving door 1 as made possible by the invention is first illustrated in FIG. 4. In the situation shown in this figure, a person wishing to leave the building is carrying, for example, a stolen object, or at least an object that was established by a sensor system 20 (shown in FIG. 6) not to be allowed to leave the building. In that situation wall segment 11 is activated, causing the same to be moved and admitting entrance to the first area 13. Simultaneously, also subject to said sensor system the further rotation of the door leaves 5, 6, 7, 8 blocks, thereby rendering passage from inside 2 of the building to outside 3 of the building impossible. After the person has entered the first area 13, the movable wall segment may optionally return to the original position in order to lock the first area 13, and the door leaves 5, 6, 7, 8 may be cleared for further rotation. Further investigation regarding the respective person may then take place in the first area 13.

Figure 5:
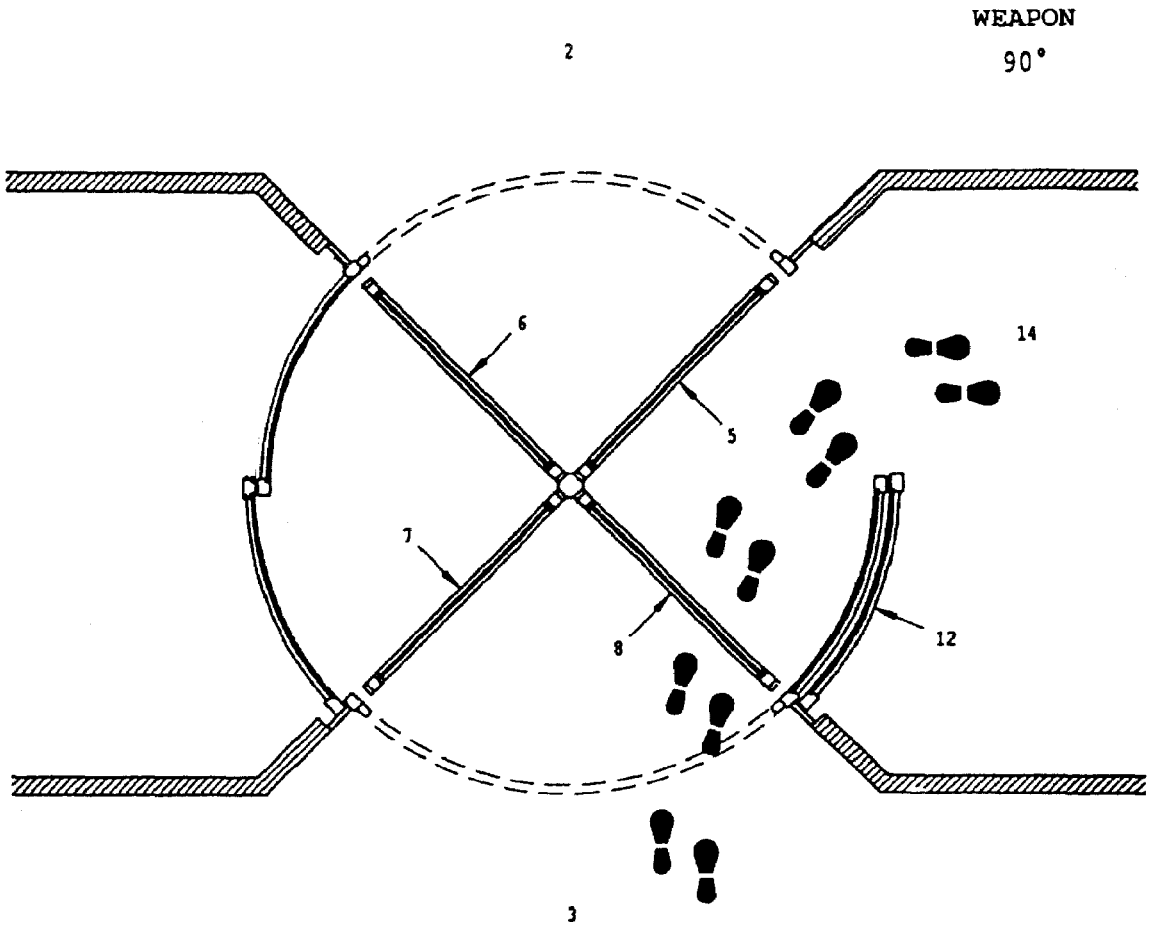
FIG. 5 is a top view of a preferred embodiment of the present invention illustrating how a security feature shunts an entering user to a secured area of a building.

FIG. 5 shows the case where a person wishes to go from the outside 3 of the building to the inside 2 of the building while carrying, for example, a weapon. When the sensor system 20 (shown in FIG. 6) detects this, it emits a signal with the result that the movable wall segment 12 is moved to the position shown, admitting entrance to the second area 13. Simultaneously, the signal from the sensor system referred to blocks the rotation of the door leaves, 5, 6, 7, 8 making admittance to the inside 2 of the building impossible and only allowing the person to enter the second area 14. After the same has arrived in the second area 14, the movable wall segment 12 may be returned to its original position, and rotation of the door leaves 5, 6, 7, 8 is cleared so that the revolving door 1 is available again for general use.

Figure 6:
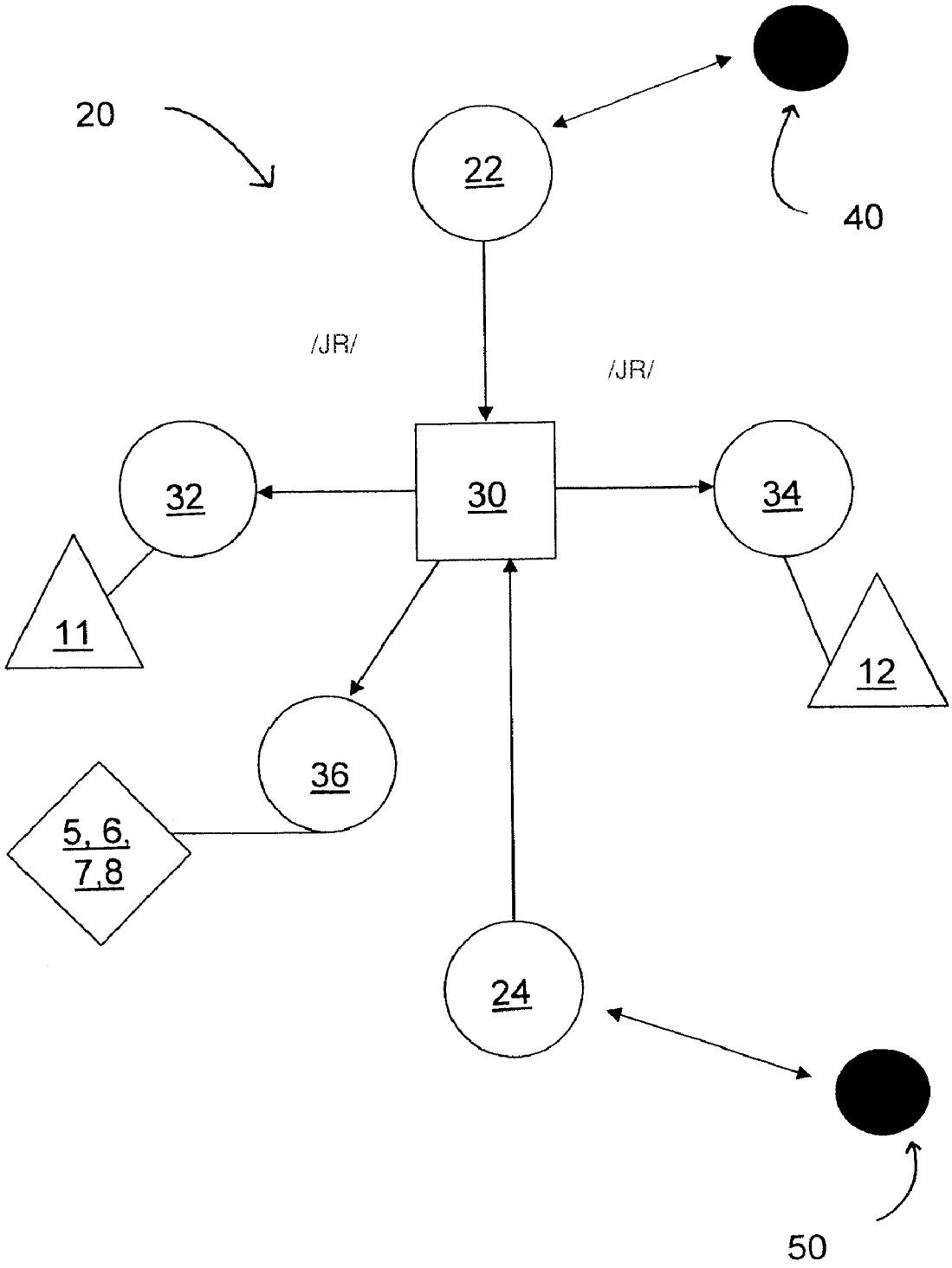
FIG. 6 is a schematic of a sensor system of an embodiment of the present invention.

FIG. 6 shows a non-limiting example of sensor system 20 comprising sensor 22 disposed in inside area 2 or in revolving door 1 to detect object 40. Similarly, sensor 24 is disposed in outside area 3 or in revolving door 1 to detect object 50. Upon detection of object 40, sensor 22 sends a signal to controller 30. Similarly, upon detection of object 50, sensor 24 sends a signal to controller 30. Controller 30 then sends a signal to component 32 and component 36 (which may include, but are not limited to, actuators or relays) in communication with moveable wall 11 and rotating door leaves 5, 6, 7, 8 to affect the closing/opening and rotation of moveable wall 11 and rotating door leaves 5, 6, 7, and 8, respectively. Similarly, controller 30 sends a signal to component 34 and component 36 (which may include, but are not limited to, actuators or relays) in communication with moveable wall 12 and rotating door leaves 5, 6, 7, 8 to affect the closing/opening and rotation of moveable wall 12 and rotating door leaves 5, 6, 7, and 8, respectively.

What is claimed is:

1. A revolving door comprising:

curved, segmented shell elements not connected to each other, the shell elements comprising at least one movable wall segment, the shell elements are positioned between an inner wall and an outer wall defining at least one containment area therebetween, and the inner wall partitions the at least one containment area from an inner area and the outer wall for partitioning the at least one containment area from an outer area;

door leaves mounted on a rotation axis, the door leaves placed between the shell elements so that the door leaves are separated from the at least one containment area by the shell elements and positioned so that the door leaves are freely rotatable and are not directly coacting with the shell elements as an edge of each door leaf moves past the shell elements during rotation of the door leaves; and a sensor system in communication with the at least one wall segment to move the at least one watt segment for opening or closing off at least one of the shell elements to the at least one containment area.

2. A revolving door according to claim 1, wherein the sensor system allows or prevents rotation of the door leaves.

3. A revolving door according to claim 2, wherein the sensor system has a first sensor for detecting objects that are to be prevented from moving past the door leaves to the inner area.

4. A revolving door according to claim 2, wherein the sensor system has a second sensor that detects objects or weapons to be prevented from moving past the door leaves to the outer area.

5. A revolving door according to claim 1, wherein the shell elements comprise a first shell element and a second shell element positioned opposite each other such that each shell element comprises at least one of the moveable wall segments, and wherein the at least one containment area comprises a first area adjacent the first shell element and a second area adjacent the second shell element such that after the first wall segment is opened, the first area can only be entered from the inner area, and that after the second wall segment is opened, the second area can only be entered from the outer area.

6. A method for operating a revolving door comprising:

providing curved, segmented shell elements not connected to each other, the shell elements comprising at least one movable wall segment;

positioning the shell elements between an inner wall and an outer wall defining at least one containment area therebetween, and wherein the inner wall partitions the at least one containment area from an inner area and the outer wall partitions the at least one containment area from an outer area;

mounting door leaves on a rotation axis and placing the door leaves between the shell elements, and separated from the at least one containment area by the shell elements, so that they are freely rotatable and are not directly coacting with the shell elements as an edge of each door leaf moves past the shell elements during rotation of the door leaves;

providing a sensor system in communication with the at least one wall segment to move the at least one wall segment for opening or closing off at least one of the shell elements to the at least one containment area disposed between an entrance area and an exit area, said containment; and providing for the sensor system to interrupt rotation of the door leaves when at least one of the shell elements is opened so that passage between the inner and outer areas is blocked.

* * * * *